US006029278A

United States Patent [19]

Lopez

[11] Patent Number: 6,029,278

[45] Date of Patent: Feb. 29, 2000

[54] SUN PROTECTION DEVICE

[76] Inventor: Guillermo Lopez, 2431 NE. 5th Ave., Boca Raton, Fla. 33431

[21] Appl. No.: 09/021,963

[22] Filed: Feb. 11, 1998

[51] Int. Cl.[7] ..... A42B 1/06; A41D 13/08

[52] U.S. Cl. ..... 2/209.13; 2/16; 2/88; 2/172; 2/206; 2/207; 2/195.1; 2/181.4

[58] Field of Search ..... 2/59, 172, 84, 2/270, 455, 468, 410, 88, 202, 207, 209.13, 16, 10, 175.3, 175.6, 181, 181.2, 181.4, 174, 171, 206, DIG. 11, 195.1

[56] References Cited

U.S. PATENT DOCUMENTS

| | | | |
|---|---|---|---|
| 216,115 | 6/1879 | Smith | 2/59 |
| 741,133 | 10/1903 | Haynes | 2/59 |
| 1,485,392 | 3/1924 | Halek | 2/84 |
| 2,086,325 | 7/1937 | Frankel | 2/84 |
| 2,170,339 | 8/1939 | Reeves | 2/84 |
| 2,558,533 | 6/1951 | Bell | 2/270 |
| 3,855,634 | 12/1974 | Gregg | 2/172 |
| 4,356,570 | 11/1982 | Vernon et al. | 2/59 |
| 4,980,928 | 1/1991 | Ellis | 2/172 |
| 5,046,195 | 9/1991 | Koritan . | |
| 5,056,157 | 10/1991 | Pryor | 2/59 |
| 5,153,943 | 10/1992 | Clement . | |
| 5,161,260 | 11/1992 | Reynolds . | |
| 5,201,077 | 4/1993 | Dondlinger . | |
| 5,212,837 | 5/1993 | Gose et al. | 2/172 |
| 5,293,646 | 3/1994 | Winston | 2/84 |
| 5,323,491 | 6/1994 | Barrett, Jr. . | |
| 5,355,535 | 10/1994 | Bruder . | |
| 5,357,633 | 10/1994 | Rael | 2/59 |
| 5,448,778 | 9/1995 | Phillips . | |
| 5,459,881 | 10/1995 | Fagan et al. | 2/84 |
| 5,493,734 | 2/1996 | Nieves-Rivera . | |
| 5,617,584 | 4/1997 | Brennan . | |
| 5,628,062 | 5/1997 | Tseng | 2/59 |
| 5,669,074 | 9/1997 | Newman, Jr. | 2/172 |
| 5,669,075 | 9/1997 | Weeks . | |
| 5,694,647 | 12/1997 | Crickmore | 2/207 |
| 5,694,648 | 12/1997 | Nucifora | 2/172 |

*Primary Examiner*—Amy B. Vanatta
*Attorney, Agent, or Firm*—Olga Gonzalea, P.A.

[57] ABSTRACT

A device for protecting the user while seated in a vehicle from the harmful effects of the sun. The sun protection device includes a headpiece, which may be a cap or headband, a face/neck cover for shielding the side of the user's face and directly exposed to the sun and a shoulder/arm cover for shielding the user's shoulder and arm directly exposed to sunlight. The device may further include a hand cover for the user's hand which is most directly exposed to sunlight, as well as a second shoulder/arm cover for the side of the user's body indirectly exposed to the sun through other vehicle openings.

17 Claims, 6 Drawing Sheets

SUN PROTECTION DEVICE

FIELD OF THE INVENTION

This invention relates to a device for protecting its user from the sun. More particularly, the present invention relates to a device for protecting the user from the harmful effects of being exposed to sunlight while the user is seated in a vehicle.

BACKGROUND OF THE INVENTION

Persons who drive for extended periods of time are often troubled by the effects of the sun. Automobile and/or truck drivers experience serious sunburn on their faces, necks, arms and hands as a result of prolonged exposure to sunlight which enters the vehicle through openings, such as the driver's side window and windshield.

Drivers must keep their hands on the steering wheel in order to properly maneuver their vehicles. The sun frequently damages the driver's exposed skin, such as the side of the body adjacent to the window and the top portion of the arms and hands, including the knuckles. Such effects are also experienced by the driver through the passenger's side window. In vehicles having open sides, such as jeeps, the aforementioned effects are even more pronounced and problematic.

In the past, hats or broad rimmed sombreros have been used to shield their wearer from the sun or rain. However, such items do not provide wearers with protection on the arms or hands, which are the body regions most directly exposed to sunlight while driving. Hats having wide rims are cumbersome to wear while driving, especially in vehicles having minimal headroom. If wind enters the vehicle it is often problematic to keep hats or sombreros in place on the head.

Capes or scarves have also been used for protection from the weather. However, such items are bulky and difficult to secure to the user. Wind entering a vehicle frequently moves such devices from their proper position and may even blow them completely off the user. Scarves may have to be encircled about the driver's neck several times in order to keep them in place. This causes discomfort in the form of heat or skin irritation in the skin areas contacting the scarf As stated above, drivers must keep their hands on the steering wheel in order to properly maneuver their vehicles. Thus, long capes which are worn loosely about the body do not offer protection for the user's hands or arms, since such capes easily slide off the user's arms as he/she raises them for the proper driving position.

Hats or headbands having capes or cloth like materials affixed thereto have been devised to cover the front or back of the wearers' face and neck. Such items may cover the wearer's hair or shoulders. However, the devices used in the past do not address the need for covering a driver's face, shoulders, arms and hands, particularly, the side of the upper body exposed to the sun through windows while seated in a vehicle as driver or passenger. Prior caps or headgear with hanging shields do not provide any coverage or protection for the arms and hands, especially the sides of such limbs most exposed to the weather while a person is seated in a vehicle. Moreover, such items are difficult to maintain in place about the user's head when the user is exposed to wind forces through vehicle windows or openings.

In summary, the devices used in the past, such as hats and capes or capes secured to headgear, completely fail to provide drivers with suitable protection against the effects of the sun while driving. The items heretofore devised for weather protection do not contemplate the problems faced by drivers who are exposed to sunlight for extended periods of time on road trips. The prior items are difficult to secure to the user and maintain in place. Moreover, they do not cover the exposed side of the upper body in vehicles or the user's arms and hands. Hence, there is a need to protect persons from the harmful effects of the sun while driving or travelling in vehicles where the upper body is exposed to sunlight. This need is met by the sun protection device of the present invention.

SUMMARY OF THE INVENTION

The device of the present invention provides protection from the effects of exposure to ultraviolet radiation in sunlight. It is suitable for protecting drivers or vehicle passengers from exposure to sunlight on extended trips. The vehicle may be a car, truck or even water borne vehicle, such as a boat, where a cablike enclosure with windows houses the steering wheel, as well as the driver's and passenger's area.

The sun protection device of the present invention has a headpiece, which may be a cap or headband, depending on the taste and desire of the user. The device further includes a face/neck cover having a size and shape suitable for covering the side of the user's face and neck most directly exposed to the sun, as through the driver's side window. The face/neck cover has an indentation in its shape in the region of the user's neck to provide comfort to the user and reduce the surface area of the face/neck cover exposed to the wind. As such, the indented shape assists in maintaining the device on the user in its intended position.

The sun protection device of the present invention also has a first shoulder/arm cover of a size and shape suitable for covering the user's shoulder and arm on the side of the body most directly exposed to sunlight, as through the driver's side window. The first shoulder/arm cover completely encircles the shoulder and arm of the user. In this sense, it is tubular in shape and tapers or narrows in diameter in the region approaching or covering the wrist of the user. With such shape, the billowing effects caused by the wind contacting the cover are avoided.

The device of the present invention may optionally include a hand cover and second shoulder/arm cover. The hand cover is intended to cover the side of the user's hand adjacent to sun exposure through the driver's side window. It is preferably horseshoe shape in perimeter and extends from the user's wrist to the tips of the user's fingers. The hand cover features an elastic loop on its interior side through which the user's finger may be passed. The loop assists in maintaining the hand cover in its desired position covering the side of the user's hand exposed to sunlight as the user maneuvers the steering wheel of his/her vehicle.

A second shoulder/arm cover may be secured to the user's other arm on the side of the body indirectly exposed to sunlight through other vehicle openings, such as the passenger's side window. The second shoulder/arm cover may be secured to the user's garment, such as shirt, about the shoulder area.

The headpiece and covers may be removably secured to one another, preferably through the use of complementary VELCRO® strips. This permits the user to select which covers are desired to be used depending on the existing weather conditions. The sun protection device of the present invention is preferably made of cotton fabric, capable of blocking ultraviolet light.

Therefore, the present invention provides comfortable and convenient protection from the effects of the weather, such as exposure to sunlight. It is particularly suitable for drivers or passengers whose upper bodies are exposed to the effects of the sun through windows or other vehicle openings. Coverage is provided for the side of the user's face and neck, as well as shoulders, arms and hand, which are the user's limbs most usually exposed to the harmful effects of ultraviolet radiation while seated in a vehicle. The device is easy to use and resistant to accidentally falling or blowing off of the user. Because the device is lightweight and may be folded, it is easy to carry and store.

DESCRIPTION OF THE INVENTION

Figure 1:
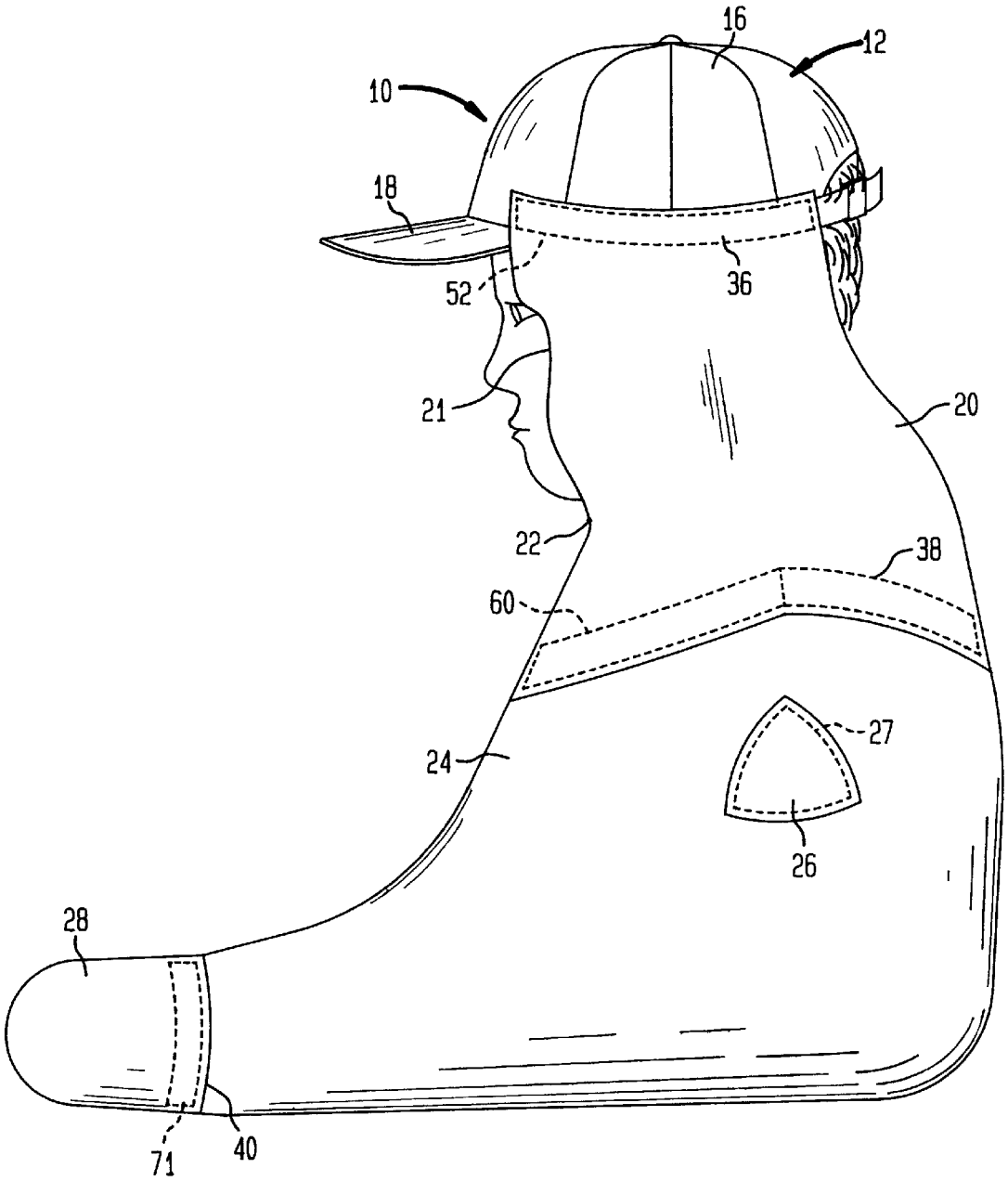
FIG. 1 is a side view of the device of the present invention in use showing the headpiece as a cap.
Figure 2:
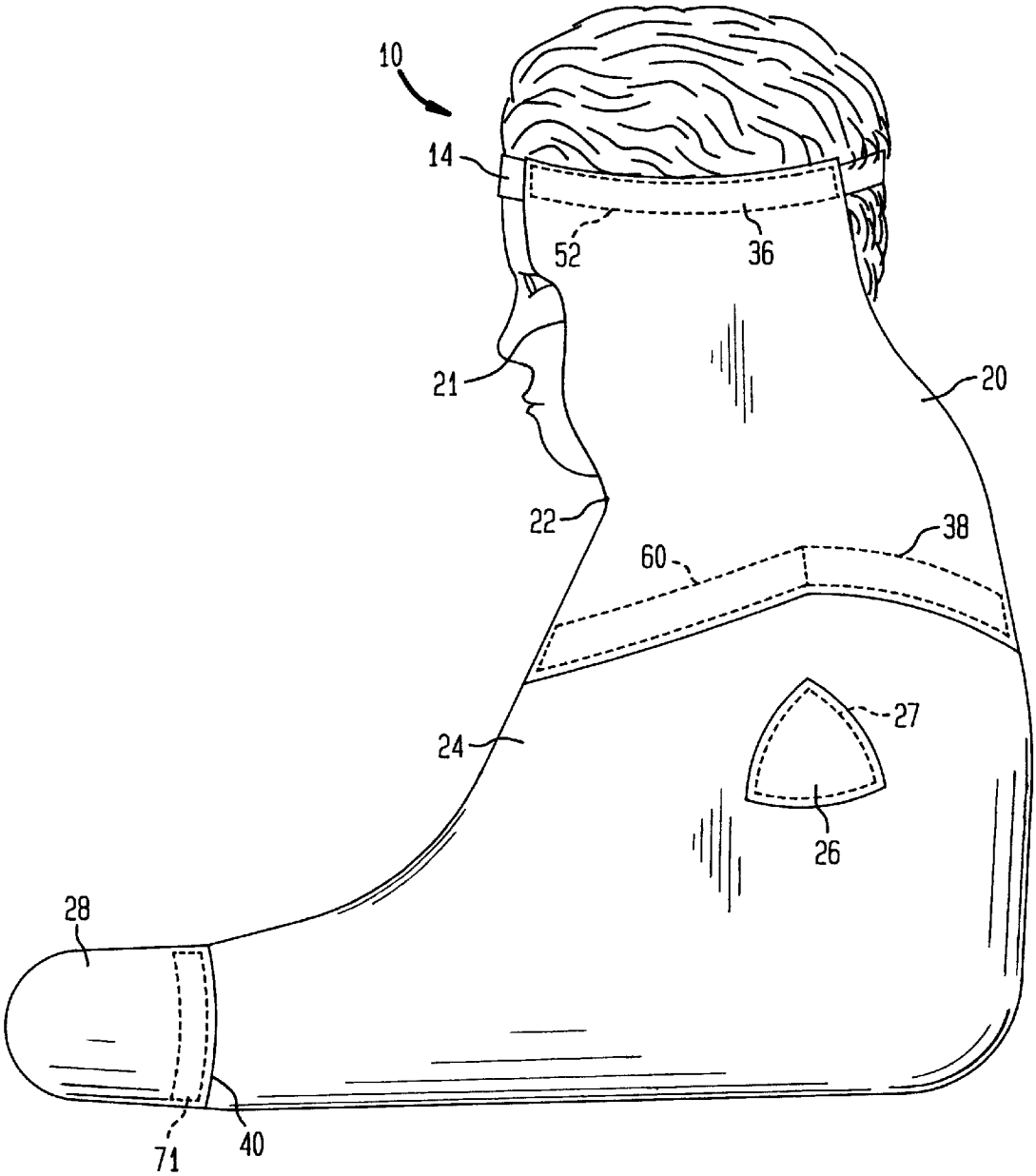
FIG. 2 is a side view of the device of the present invention in use showing the head piece as a headband.

Referring to the drawings, particularly FIG. 1 and FIG. 2, there is shown the sun protection device of the present invention as in use, represented by reference number 10. Weather protection device 10 has a headpiece which snugly encircles the circumference of the user's head when device 10 is in use and it provides a point or location for attachment of the remaining components of the present invention to the user. In using the device of the present invention, the headpiece is placed about the user's head just above the eyebrows. The headpiece is shown as cap 12 in FIG. 1 and as a headband 14 in FIG. 2. Either form, as headband or cap, is suitable for the use of this invention. In the form of a cap, greater protection against the effects of sunlight, is provided to the user's head and face. In the form of a headband, greater visibility of the user's coiffure is provided. Headband 14 is preferably used when the user desires air circulation in the region of the crown of the head.

Cap 12 has a crown portion 16 which covers the crown of the user's head and a visor 18 which serves to partially shield the user's face, particularly the region of the forehead and eyes. Cap 12 is preferably made of a woven, knitted, or pressed fabric of fibrous material, such as cotton, which is breathable in that it permits the circulation of air through the fabric and around the user's head. Headband 14 is a band or strip capable of easily contracting and expanding as desired by the user to fit snugly along the circumference of the user's head. It is preferably made of an elastic and sweat absorbent material, such as a knit-cotton elastic material.

Sun protection device 10 further includes a cover for one side of the face and neck, represented by reference number 20 and referred to herein as face/neck cover 20. Face/neck cover 20 is secured to cap 12 or headband 14 so as to shield one side of the user's face and neck. As used herein, the term "cover" is intended to mean a piece or segment of soft, flexible material having a size and shape suitable for shielding the surface it is placed against from the ultraviolet radiation of sunlight. When the device is used while driving, face/neck cover 20 is intended to shield the side of the user's face and neck which is most directly exposed to the sun. This is usually the side adjacent to the driver's side window. This may be the left or right side of the face and neck depending on the convention or location of the steering wheel in the vehicle.

Face/neck cover 20 has a first arcuate indentation in its shape, represented by reference number 21, which projects inwardly adjacent to the user's eye and cheekbone area when device 10 is in use. With such shape, coverage of the face is provided without interference from coverage which might obstruct the user's side view. Face/neck cover 20 has a second arcuate indentation in its shape, represented by reference number 22, which projects inwardly below the user's chin. With such indentation in shape, coverage of face, including the eyes and cheeks is provided, without interference from coverage below the chin, where flesh or skin is usually absent. As such, face/neck cover 20 provides comfort to the user and is aerodynamic in shape, a feature which avoids the billowing effects that may result as the user picks up speed in his/her vehicle and air or wind contacts face/neck cover 20. Indentation 22 reduces the area of face/neck cover 20 contacted by the wind and as such its serves to enhance the device's 10 ability to remain on the user while in use.

It should also be noted that face/neck cover 20 extends laterally along the user's profile. The back of the user's head is not covered by face/neck cover 20. Face/neck cover 20 is thus intended to shield only the side of the user's head and face from sunlight entering the vehicle's side. Because face/neck cover 20 does not cover the back of the user's head, it is aerodynamic in shape. Wind or air does not come into contact with face/neck cover 20 in the region of the back of the user's head and accordingly does not exert forces on face/neck cover 20 which might cause it to separate from cap 12 or headpiece 14.

Figure 6:
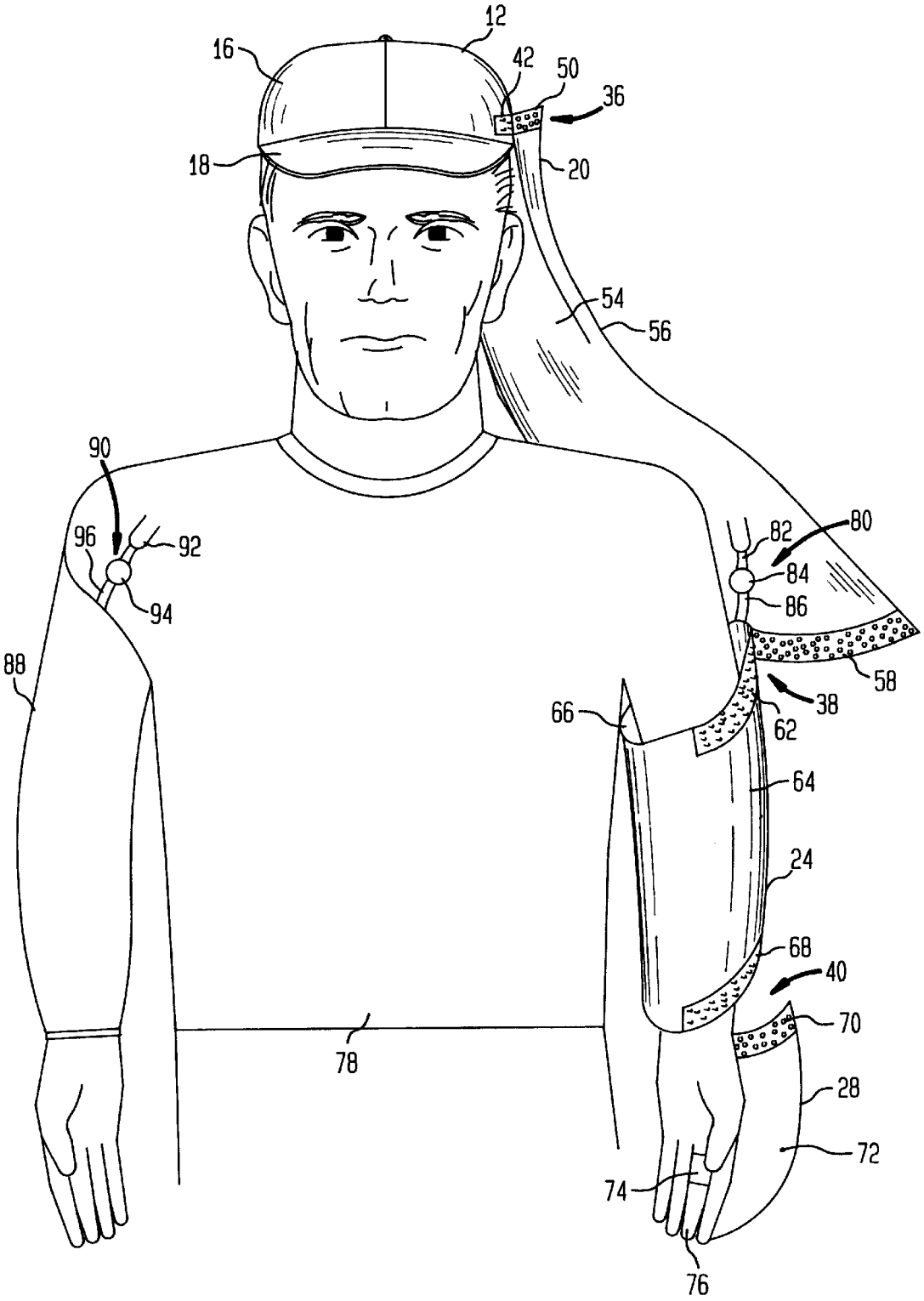
FIG. 6 is a front view of the device of the present invention in use.

Sun protection device 10 also includes a first shoulder/arm cover 24 for the user's shoulder which is most directly exposed to the effects of the sun through the driver's side window. First shoulder/arm cover 24 extends from the user's shoulder to just above the user's wrist. First shoulder/arm cover 24 is tubular in shape and narrows or tapers about the wrist area. As shown in FIG. 6, first shoulder/arm cover 24 completely encircles the user's elbow and forearm. This shape avoids the entry of wind through the wrist area, as well as the billowing effect which may result from such entry, and assists in maintaining first shoulder/arm cover 24 in the desired position while in use. First shoulder/arm cover 24 may have a logo 26 affixed thereto. Logo 26 may be a mark or illustration to identify the manufacturer of the device or the person or organization associated with the use of the device. It may be affixed to first shoulder/arm cover 24 by stitching 27. Alternatively, logo 26 may be attached to first shoulder/arm cover 24 through the use of adhesives.

Sun protection device 10 may optionally include hand cover 28. Hand cover 28 extends from the user's wrist where first shoulder/arm cover 24 terminates to the tips of the user's fingers. It is preferably horseshoe shape in perimeter, but may have any desired shape, such as square or rectangular, suitable for covering the top of the user's hand. Hand cover 28 shields the top surface of the user's hand, including the knuckles and fingers. As with first shoulder/arm cover 24, hand cover 28 is intended to be worn by the user on the hand closest to the driver's side window, which suffers the most exposure to the harmful effects of the sun as the driver steers his/her vehicle. In some situations when the sun is not very strong, the user may opt not to use hand cover 28.

Covers 20, 24 and 28 are preferably made of a breathable material such as cotton fabric capable of blocking ultraviolet radiation. As used herein "ultraviolet" is intended to mean a band of electromagnetic radiation having wavelengths, from about 5 to about 400 nanometers, that are shorter than violet light. Covers 20, 24 and 28 may be formed of a single continuous sheet of material. As used herein "continuous" is intended to mean extending without interruption or break. Alternatively, covers 20, 24 and 28 may each be separate pieces, permanently secured or connected together by stitching or adhesives. However, it is preferred that covers 20, 24 and 28 be removably secured to one another so that the user may select which cover he/she desires to use depending on the weather conditions, as well as direction or angle of entry of sunlight into the vehicle. Similarly, the headpiece, cap 12 or headband 14, is preferably removably secured to face/neck cover 20. In other words, covers 20, 24 and 28 may be secured to one another while in use and may be separated from one another for storage or when the user does not wish to use all covers at the same time. For example, the user may desire to use only the following components: cap 12 in combination with face/neck cover 20 and first shoulder/arm cover 24. Such removable securement is accomplished through the use of first securement means 36 which serves to removably attach cap 12 or headband 14 to face/neck cover 20, second securement means 38 to removably attach face/neck cover 20 to first shoulder/arm cover 24, and third securement means 40 to removably attach hand cover 28 to first shoulder/arm cover 24.

Thus, as used herein, "securement means" refers to one or more pieces or parts suitable for attaching covers 20, 24 and 28, as well as cap 12 or headband 14, to one another at the locations described herein and for easily removing such attachment. Securement means may be a combination of buttons and complementary eyelets, such that attachment is accomplished by engaging or passing one or more buttons through the corresponding eyelets and removal of attachment is accomplished by disengaging or taking the buttons out of contact with the corresponding eyelets. However, in this invention, the preferred securement means is complementary strips of hook and loop material, commonly referred to as VELCRO®. When hook and loop material come into contact as by pressing the materials together, a bond is made between them resulting in attachment of the component or components having the hook and loop material. This bond may be easily broken by lifting or parting the hook and loop material away from each other. Accordingly, strips of hook and loop material are attached, by stitching or the use of adhesives, to the areas or locations of the device of the present invention where removable securement is desired.

Figure 3:
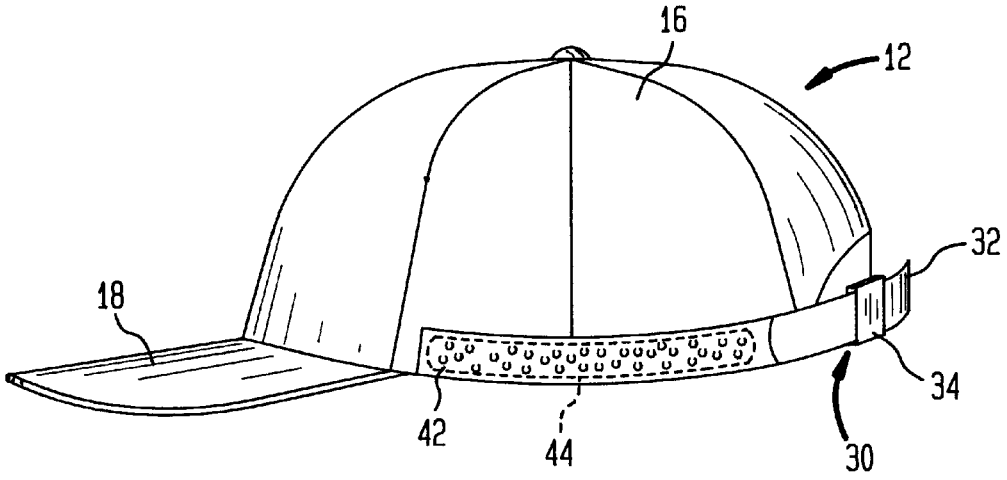
FIG. 3 is a side view of the cap of the present invention.

Turning now to FIG. 3, there is shown a side view of cap 12. The circumference of cap 12 may be adjusted by adjustment means 30. As used herein "adjustment means" refers to one or more parts or pieces suitable for varying the circumference of cap 12 such that it can be tightened or loosened about the head of the user. Adjustment means 30 includes adjustment strap 32 and adjustment clip 34. Strap 32 is passed through adjustment clip 34 until its position is reached where the circumference of cap 12 matches the circumference of the user's head such that cap 12 fits snugly thereon. The contact between adjustment clip 34 and adjustment strap 32 keeps adjustment strap 32 in its desired location. Other adjustments means for the circumference of the cap are well known in the art and may be used in the practice of this invention.

Figure 4:
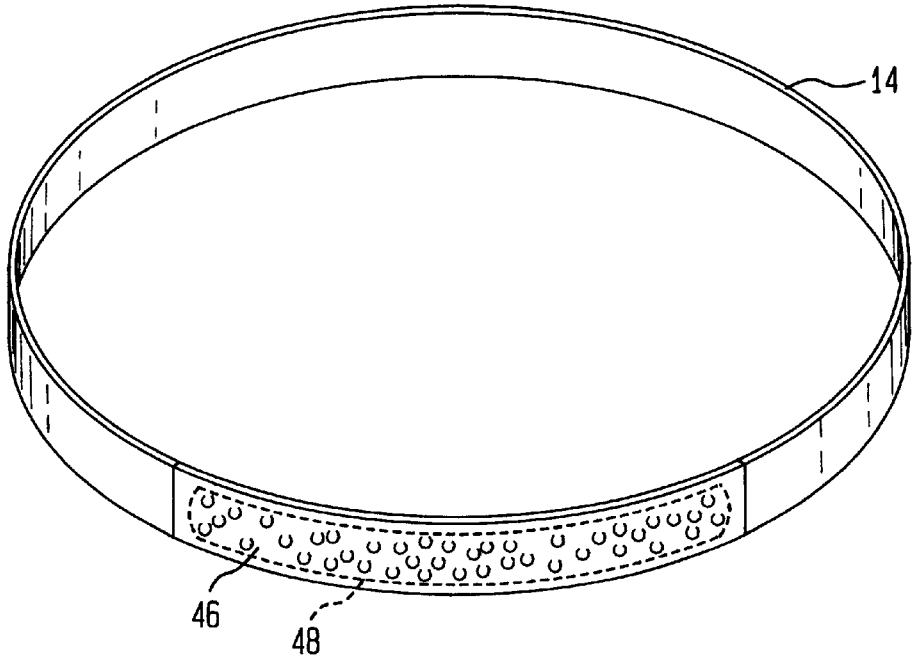
FIG. 4 is a side view of the headband of the present invention.

As stated above, first securement means 36 serves to removably attach cap 12 or headband 14 to face/neck cover 20. Cap 12 has strip of hook material 42 along the side of cap 12 where face/neck cover 20 is to be removably secured to cap 12 so as to shield one side of the user's face and neck. Cap hook strip 42 may be secured to cap 12 by stitching 44. Alternatively, cap hook strip 42 may be attached to cap 12 through the use of adhesives. As shown in FIG. 4, headband 14 has a strip of hook material 46 along the side of headband 14 where face/neck cover 20 is to be removably secured to headband 14 so as to shield one side of the user's face and neck. Headband hook strip 46 may be attached to headband 14 by stitching 48 or through the use of adhesives.

Figure 5:
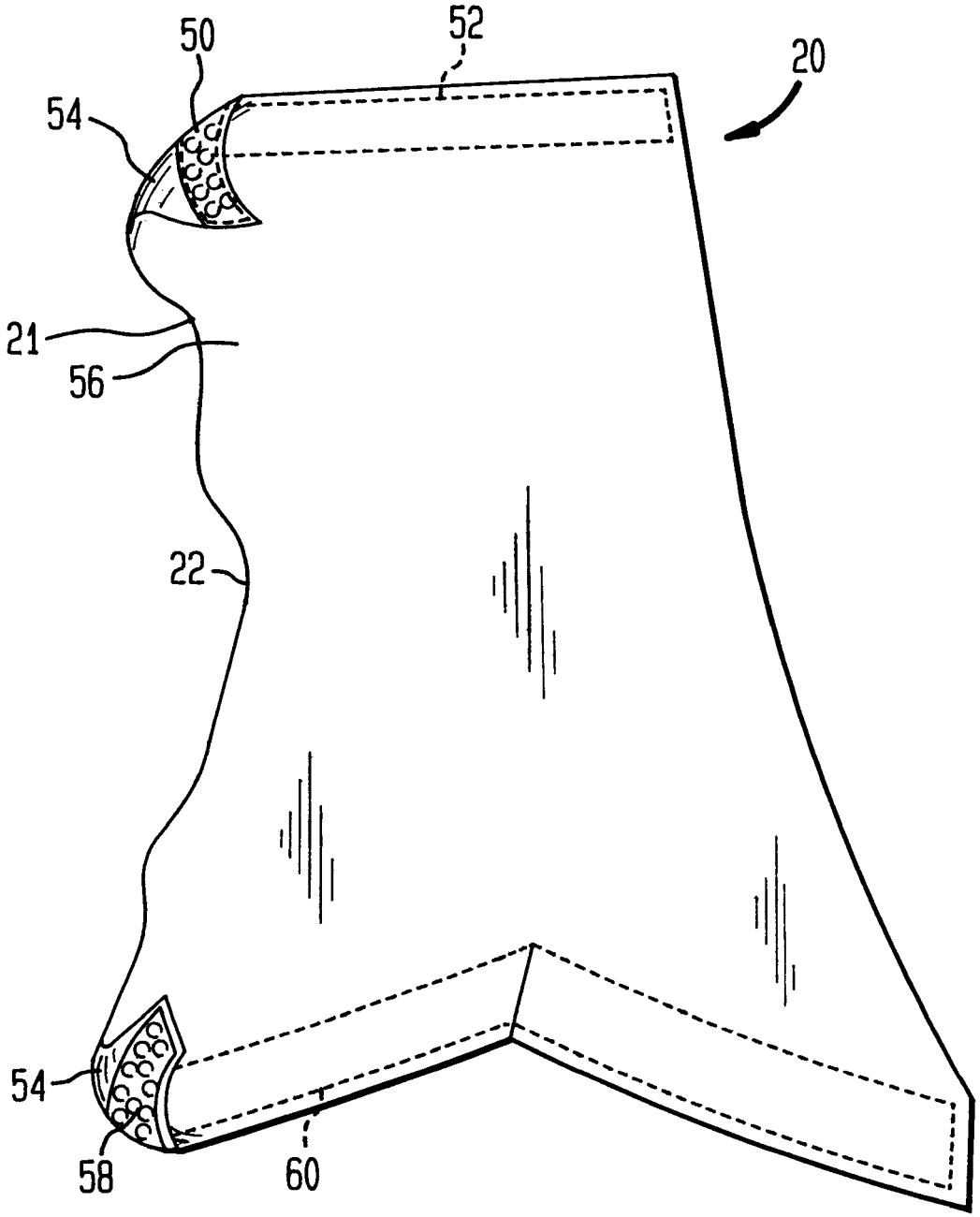
FIG. 5 is a plan view of the face/neck cover of the present invention.

Cap hook strip 42 and headband hook strip 46 are shown as rectangular in shape. However, they may be of any desired shape so long as sufficient material is provided to bind to the complementary loop material on face/neck cover 20. As used herein "complementary" is intended to mean mateable or capable of binding to each other as by pressing together of the materials. More specifically, cap hook strip 42 should be of sufficient size and shape to bind to loop strip 50 on face/neck cover 20. Similarly, headband hook strip 46 should be of sufficient size and shape to bind to loop strip 50 on face/neck cover 20. As shown in FIG. 5, loop strip 50 is attached to face/neck cover 20 by stitching 52 or through the use of adhesives. In FIG. 5, the upper left corner of face/neck cover 20 is shown slightly turned to reveal interior side 54 of face/neck cover 20. When device 10 is in use, interior side 54 faces the user and exterior side 56 faces the driver's side window or elements. As shown in FIG. 3 and FIG. 5, when cap 12 is used, first securement means 36 includes cap hook strip 42 on cap 12 and complementary loop strip 50 on interior side 54 of face/neck cover 20. As shown in FIG. 4 and FIG. 5, when headband 14 is used, first securement means includes headband hook strip 46 on headband 14 and complementary loop strip 50 on interior side 54 of face/neck cover 20. By parting or separating the complementary strips away from each other, face/neck cover 20 can be easily removed from cap 12 or headband 14. The pressing together of the complementary material results in removable securement of face/neck cover 20 to cap 12 or headband 14.

As stated above, second securement means 38 serves to removably attach face/neck cover 20 to first shoulder/arm cover 24. In FIG. 5, the lower left corner of face/neck cover 20 is shown slightly turned to also reveal interior side 54 of face/neck cover 20. The bottom edge of face/neck cover 20 has loop material strip 58 affixed thereto by stitching 60. It may also be affixed through the use of adhesives. Loop strip 58 on interior side 54 of face/neck cover 20 is complementary to hook strip 62 on exterior side 64 of first shoulder/arm cover 24. As shown in FIG. 5 and FIG. 6, second securement means 38 includes loop strip 58 on the bottom edge of interior side 54 of face/neck cover 20 and complementary hook strip 62 on exterior side 64 of first shoulder/arm cover 24. Interior side 66 of first shoulder/arm cover 26 completely encircles the user's arm. As such, first shoulder/arm cover 24 is tubular in shape. It narrows or tapers in the region of third securement means 40 approaching the user's wrist. This tubular shape avoids any billowing effect of first shoulder/arm cover 24 which might be caused by wind forces. For comfort to the user, interior side 66 of first shoulder/arm cover 24 does not have hook or loop material strips attached thereto. By parting or separating the complementary strips away from each other, first shoulder/arm cover 24 may be easily removed from face/neck cover 20. As stated above, the pressing together of the complementary materials results in removable securement of first shoulder/arm cover 24 to face/neck cover 20.

Third securement means 40 serves to removably attach hand cover 28 to first shoulder/arm cover 24. Third securement means 40 includes hook strip 68 on the bottom edge of exterior side 64 of first shoulder/arm cover 24 and complementary loop strip 70 on interior side 72 of hand cover 28. Loop strip 70 is attached to hand cover 28 by stitching 71 or through the use of adhesives. By parting or separating the complementary strips away from each other, hand cover 28 may be easily removed form first shoulder/arm cover 24. The pressing together of the complementary materials results in removable securement of hand cover 28 to shoulder/arm cover 24. The strips of hook and loop material are shown in the drawings as rectangular in shape. However, they may be of any shape suitable for providing sufficient binding of the complementary material for securement.

Figure 7:
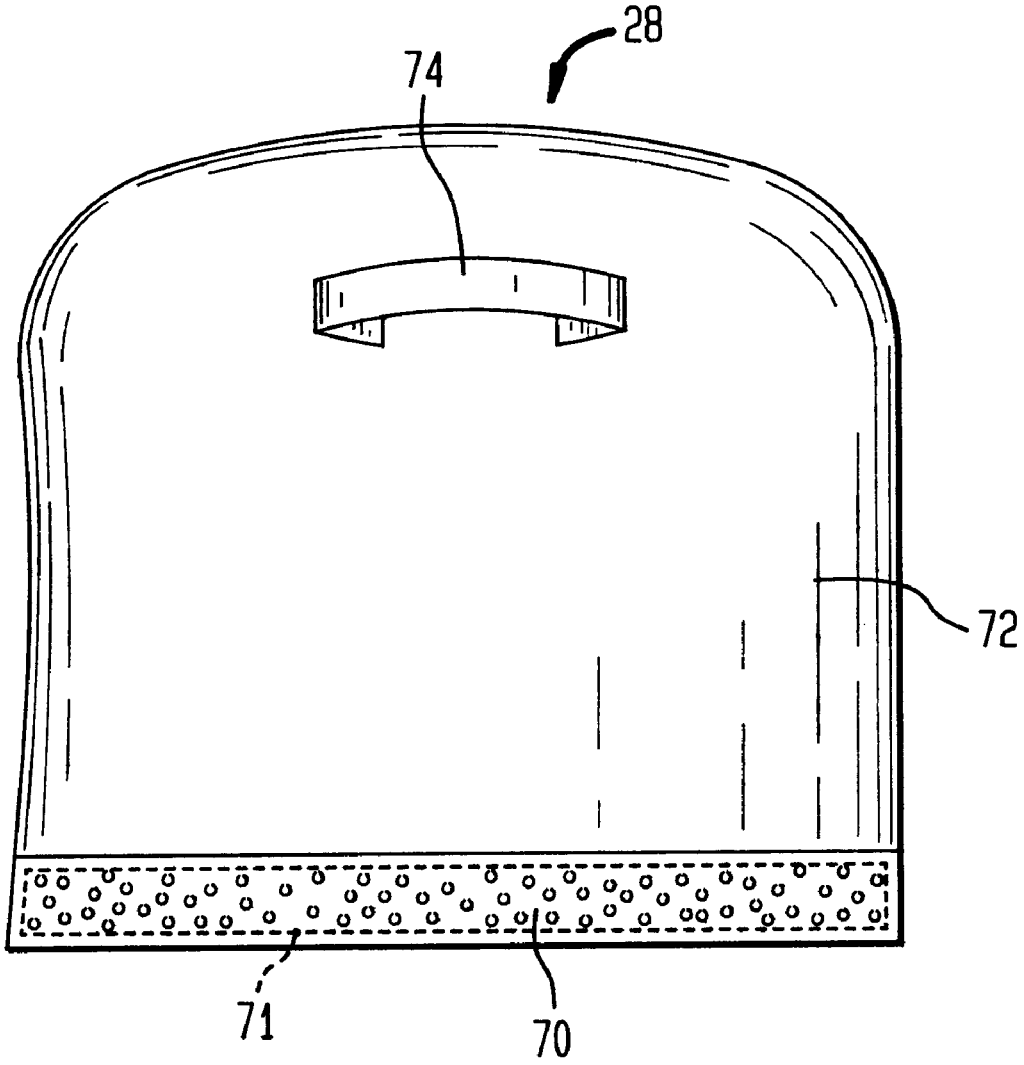
FIG. 7 is a plan view of the interior side of the hand cover of the present invention.

As shown in FIG. 6 and FIG. 7, hand cover interior side 72 also has attached to its center finger loop 74. The user's middle finger 76 passes through finger loop 74. When so encircled, finger loop 74 serves to maintain hand cover 28 on the user's hand. The aforementioned use of finger loop 74 is especially helpful in keeping hand cover 28 in its desired position when the user must raise his/her hands to maneuver the vehicles' steering wheel. Finger loop 74 may be made of elastic or cloth and it is affixed to hand cover 28 through the use of adhesives or stitching.

If attachment of first shoulder/arm cover 24 to the user's garment 78 is desired, first shoulder/arm cover 24 may further have a garment attachment means 80. As used herein "garment attachment means" refers to one or more pieces or parts suitable for attaching shoulder/arm cover 24 to garment 78. As shown in FIG. 6, garment attachment means includes garment attachment clip 82 which grabs the garment 78 when it is in the closed position and releases the garment in the open position. A used herein "garment" is intended to mean clothing worn by the user on his/her upper torso, such as shirt, T-shirt, top, blouse and the like. Garment attachment clip 82 opens when the user exerts pressure thereon with his/her fingers and closes when the user releases such pressure. Garment attachment clip 82 is affixed to first shoulder/arm cover 24 through an elastic band 86 passing through ring 84. Garment attachment clip 80 and ring 84 are preferably made of a durable or resistant material, such as plastic.

The sun protection device may optionally include second shoulder/arm cover 88, having the shape and construction as described for first shoulder/arm cover 24. Second shoulder/arm cover 88 is also preferably made of a breathable material such as cotton fabric capable of blocking ultraviolet radiation. Second shoulder/arm cover 88 may be directly attached to garment 78 through garment attachment means 90, including garment attachment clip 92 which grabs the garment 78 when it is in the closed position and releases the garment in the open position. Garment attachment clip 92 opens when the user exerts pressure thereon with his/her fingers and closes when the user releases such pressure. Garment attachment clip 92 is affixed to first shoulder/arm cover 24 through an elastic band 96 passing through ring 94. Garment attachment clip 80 and ring 84 are preferably made of a durable or resistant material, such as plastic. Second shoulder/arm cover 88 need not have hook or loop material in the region of the user's shoulder or wrist as does first shoulder/arm cover 24. Second shoulder/arm cover 88 is particularly useful in situations where the driver is subjected to the effects of ultraviolet radiation on both his/her left and right sides, as through sunlight entering the vehicle from both driver's side and passenger's side windows.

The invention described herein provides comfortable and convenient protection against the sun for persons who drive or travel for extended periods of time and are subjected to the harmful effects of sunlight through vehicle openings. The device of the present invention provides protection for the side of the user's body exposed to sunlight through vehicle openings. The user's face, neck, shoulder, arm and hand are protected with the device of the present invention. The device of the present invention is made of lightweight materials and may be folded. It may be easily carried in bags or backpacks and may be stored in small areas, such as glove compartments.

While the invention has been described in detail for the preferred form shown, it will be understood that modifications may be made without departing form the spirit and scope of the invention and the appended claims.

What is claimed is:

1. A device for providing its user protection from the sun comprising:

(a) a headpiece;

(b) a face/neck cover of a shape suitable for shielding only one side of the user's face and neck without shielding the back of the user's head, said face/neck cover having a first arcuate indentation projecting inwardly adjacent to the user's eye and cheekbone area and a second arcuate indentation projecting inwardly below the user's chin area; and (c) a shoulder/arm cover for the user's shoulder and arm, said shoulder/arm cover being of a tubular shape narrowing towards the user's wrist, capable of covering the user's shoulder and completely encircling the user's elbow and forearm.

2. The device of claim 1 further comprising a cover for shielding only the top surface of the user's hand, said hand cover being a single, flat piece of material having a horseshoe shaped perimeter extending from the user's wrist to the tips of the user's fingers and having an elastic loop for placement therethrough and securement thereto of a finger of the user.

3. The device of claim 1 made of cotton fabric capable of blocking ultraviolet radiation.

4. The device of claim 1 further comprising a second shoulder/arm cover for the user's other shoulder and arm, said shoulder/arm cover being of a tubular shape narrowing towards the user's wrist, capable of covering the user's shoulder and completely encircling the user's elbow and forearm.

5. The device of claim 2 further comprising a second shoulder/arm cover for the user's other shoulder and arm, said shoulder/arm cover being of a tubular shape narrowing towards the user's wrist, capable of covering the user's shoulder and completely encircling the user's elbow and forearm.

6. The device of claim 1 wherein the headpiece is a cap.

7. The device of claim 1 wherein the headpiece is a headband.

8. A device for providing its user protection from the sun comprising:

(a) a headpiece for encircling the circumference of the user's head;

(b) a face/neck cover for shielding only one side of the user's face and neck without shielding the back of the user's head, said face/neck cover being removably securable to said headpiece and having a first arcuate indentation projecting inwardly adjacent to the user's eye and cheekbone area and a second arcuate indentation projecting inwardly below the user's chin area; and (c) a shoulder/arm cover for shielding the user's shoulder and arm, said shoulder/arm cover being removably securable to said face/neck cover and being of a tubular shape narrowing towards the user's wrist, capable of covering the user's shoulder and completely encircling the user's elbow and forearm.

9. The device of claim 8 further comprising a hand cover for shielding only the top surface of the user's hand, said hand cover being removably securable to said shoulder/arm cover and being a single, flat piece of material having a horseshoe shaped perimeter extending from the user's wrist to the tips of the user's fingers and having an elastic loop for placement therethrough and securement thereto of a finger of the user.

10. The device of claim 8 made of cotton fabric capable of blocking ultraviolet radiation.

11. The device of claim 8 further comprising a second shoulder/arm cover for shielding the user's other arm said shoulder/arm cover being of a tubular shape narrowing towards the user's wrist, capable of covering the user's shoulder and completely encircling the user's elbow and forearm.

12. The device of claim 9 further comprising a second shoulder/arm cover for shielding the user's other arm said shoulder/arm cover being of a tubular shape narrowing towards the user's wrist, capable of covering the user's shoulder and completely encircling the user's elbow and forearm.

13. The device of claim 8 wherein the headpiece is a cap.

14. The device of claim 8 wherein the headpiece is a headband.

15. A device for providing its user protection against the sun comprising:

(a) a shoulder/arm cover for shielding the user's shoulder and arm, said shoulder/arm cover being of a tubular shape narrowing towards the user's wrist, capable of covering the user's shoulder and completely encircling the user's elbow and forearm; and (b) means for securing said shoulder/arm cover to the user's garment, said means comprising an elastic band affixed to said shoulder arm cover, a ring having said elastic band passed therethrough, and a garment attachment clip attached to said ring and capable of being releasably secured to the garment.

16. A device for providing its user protection from the sun comprising a headpiece and a cover continuous to said headpiece for shielding one side of the user's face, neck, shoulder, arm and only the top surface of the user's hand, without shielding the back of the user's head, wherein said cover has a first arcuate indentation projecting inwardly adjacent to the user's eye and cheekbone area, a second arcuate indentation projecting inwardly below the user's chin area, and is tubular in shape, narrowing towards the user's wrist and capable of completely encircling the user's elbow and forearm.

17. A device for providing its user protection from the sun comprising:

(a) a headpiece; and (b) a face/neck cover for shielding only one side of the user's face and neck without shielding the back of the user's head, said face/neck cover having a first arcuate indentation projecting inwardly adjacent to the user's eye and cheekbone area and a second arcuate indentation projecting inwardly below the user's chin area.

* * * * *